United States Patent [19]

Colombo et al.

[11] Patent Number: 4,901,898

[45] Date of Patent: Feb. 20, 1990

[54] WAIST-MOUNTED INFANT CARRIER

[76] Inventors: Richard J. Colombo; Margaret A. Colombo, both of 7769 Dryer Rd., Victor, N.Y. 14564

[21] Appl. No.: 244,027

[22] Filed: Sep. 14, 1988

[51] Int. Cl.[4] ..... A47C 5/12

[52] U.S. Cl. ..... 224/159; 224/224; 224/270

[58] Field of Search ..... 224/159, 158, 160, 161, 224/270, 224, 226, 253, 907

[56] References Cited

U.S. PATENT DOCUMENTS

| | | | |
|---|---|---|---|
| 781,033 | 1/1905 | Sutter | 224/159 |
| 1,464,404 | 8/1923 | Blekastad | 224/159 |
| 3,698,608 | 10/1972 | Entwistle | 224/159 |
| 4,319,704 | 3/1982 | Rosen | 224/270 |
| 4,790,459 | 12/1988 | Moseley | 224/159 |

FOREIGN PATENT DOCUMENTS

| | | | |
|---|---|---|---|
| 1215795 | 4/1960 | France | 224/159 |

*Primary Examiner*—Renee S. Luebke
*Attorney, Agent, or Firm*—Warren W. Kurz

[57] ABSTRACT

An infant carrier adapted to be worn about the waist of an adult for supporting and transporting an infant on the hip of the wearer. According to a preferred embodiment, such carrier comprises a shaped member having first and second contoured portions joined along an arcuate line approximating the waist line of the intended wearer. The first contoured portion is shaped to receive and support the buttocks and legs of an infant who is positioned to face the adult wearer with legs straddling the wearer's waist. The second contoured portion is shaped to the hip region of the wearer. The carrier may also include a belt for securing the shaped member to the wearer's waist. By virtue of its design, the weight of the infant is broadly distributed about the wearer's waist and hip region, thereby avoiding the neck and shoulder strain characteristic of heretofore proposed infant carriers.

3 Claims, 3 Drawing Sheets

WAIST-MOUNTED INFANT CARRIER

BACKGROUND OF THE INVENTION

The present invention relates to improvements in apparatus for carrying and transporting infants and small children. More particularly, it relates to improvements in infant carriers of the type which are adapted to be worn by an adult and serve to support an infant at or about the waist level of the adult wearer.

From time immemorial, adults have carried infant children in the very natural position in which the child's legs straddle the adult's waist with the child's buttocks resting against the adult's hip bone. This position allows the adult to support the child's back with one arm, allowing the other arm to be used for other purposes. While the adult's hip provides some support for the child, it is the arm which bears most of the child's weight. As everyone knows who has carried infants in this manner, the arm soon grows weary and it is necessary to keep shifting the child from one side to the other in order to rest one arm or the other.

To alleviate the strain on the arms of those who carry infants for any extended period of time in the manner described above, many different types of infant-carrying devices have been proposed. Such devices serve, in effect, to shift all or most of the weight of the infant from the bearer's arms to other, more sizeable muscles. See, for example, the infant carriers disclosed in U.S. Pat. Nos. 484,065; 576,292; 2,409,331; 2,411,721; and 3,197,100. All of the infant carriers disclosed in these patents have in common a platform of some sort for supporting the infant, and one or more straps for suspending such platform from the shoulder(s) or neck of the wearer. While infant carriers of this type are advantageous from the standpoints that they do provide a more secure support for the infant, they tend to be problematic in that their associated support straps tend to strain the shoulder and neck muscles of the wearer. Moreover, these shoulder straps are sometimes a nuisance for the wearer to put on, and often present an obstacle in properly positioning the infant in the carrier.

SUMMARY OF THE INVENTION

In view of the foregoing discussion, an object of this invention is to provide an improved infant carrier of the aforementioned type, a carrier which is improved at least from the standpoints that it presents absolutely no shoulder and neck strain for the wearer, and it has no potentially troublesome shoulder straps. The infant carrier of the invention is adapted to be worn about the waist of an adult and, according to a preferred embodiment, basically comprises a shaped member having a generally V-shaped cross section. Such member defines contoured seat and skirt portions joined along an arcuate line approximating the waist line of the intended wearer. The contoured seat portion has a shape adapted to receive and support the buttocks of an infant who is positioned to face the adult wearer with legs straddling the wearer's waist. The contoured skirt portion is shaped to the hip region of the wearer and is adapted to fit inside the waist band of the wearer's skirt or pants so that the shaped member is supported along the arcuate line along which the seat and skirt portions are joined by the user's belt. Alternatively, a belt is provided for securing the shaped member to the wearer's waist.

According to a second embodiment, the shaped member is made from a resilient material, such as sponge rubber, and a rigid V-shaped support is embedded in the sponge rubber to reinforce the support for an infant who is seated on such member. In this embodiment, a belt or the like is provided to secure the shaped member to the waist of the wearer.

The invention and its various advantages will become more evident to those skilled in the art from the ensuing detailed description, reference being made to the accompanying drawings.

DETAILED DESCRIPTION OF PREFERRED EMBODIMENTS

Figure 1:
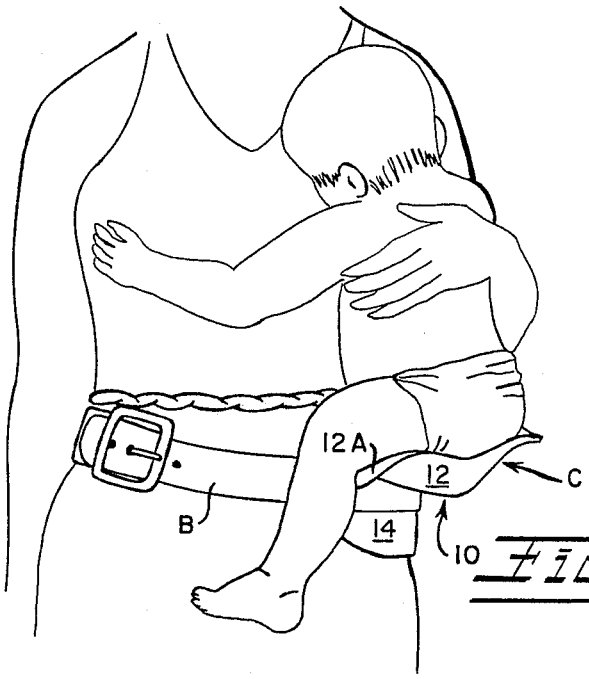
FIG. 1 is a perspective view of a preferred embodiment of the infant carrier of the invention in use.
Figure 2:
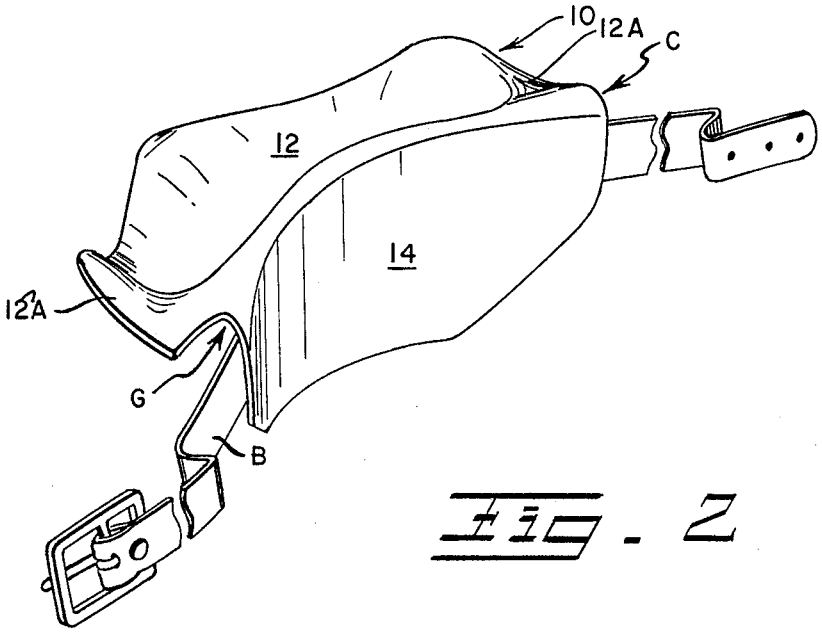
FIG. 2 is an enlarged perspective view of the carrier shown in FIG. 1.
Figure 3:
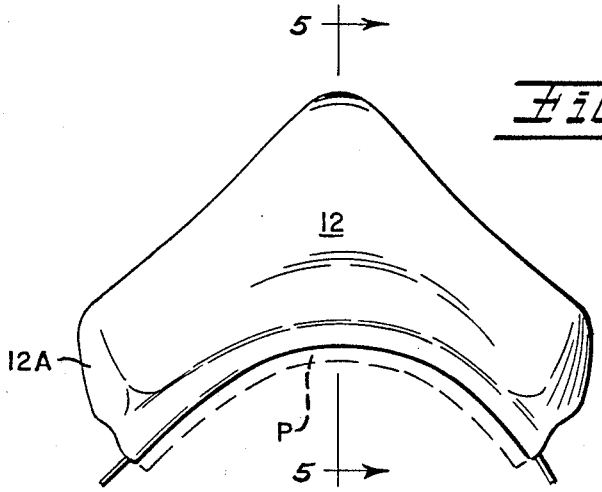
FIGS. 3 and 4 are top and side views, respectively, of the carrier shown in FIG. 1.
Figure 4:
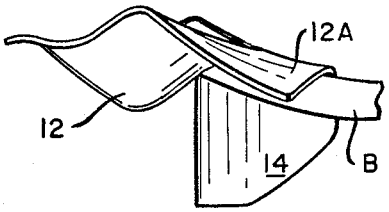

Referring now to the drawings, FIGS. 1–5 illustrate a preferred embodiment of the invention in which an infant carrier C comprises a shaped member 10 which is adapted to be worn about and secured to the waist of a user/wearer by a conventional belt B. The shaped member is a unitary structure which defines a contoured seat portion 12 and a waist portion 14. Seat portion 12 and skirt portion 14 are joined along an arcuate interface having a contour, defined by a line which approximates the contour of the waistline of an adult wearer. Seat portion 12 is sculptured to receive and support the buttocks of an infant whose legs straddle the waist of the carrier wearer, as shown, whereas skirt portion 14 is contoured to the hip region of the carrier wearer.

Preferably, shaped member 10 is injection molded from polypropylene or from other suitable plastics, and its shape is such that one can be stacked upon the other for compactness in shipping and storage. Alternatively, the shaped member can be sculptured from other materials. including fiberglas, metal, textiles, etc. It is also preferred that the skirt portion be somewhat flexible so that, in tightening of the belt, the skirt takes the shape of the wearer's hip region. In contrast, the seat portion and the interface along which the seat and skirt portions are joined are somewhat more rigid than the skirt portion to prevent undue bending when in use. When made of plastic, the preferred thickness of the seat portion and interface is approximately 5 mm., whereas the preferred thickness of the skirt portion is only about 2 or 3 mm. Also preferred is that the downwardly sloping regions **12*a*** where the infant's legs extend outwardly from the seat portion gradually taper in thickness from 5 mm. to 3 mm. so that the weight of the infant's legs cause such regions to flex for added comfort. A compressible pad (not shown) may be adhesively bonded to the seat portion in a position to be compressed by an infant positioned, as shown, in the carrier. Such a pad serves as a shock absorber during movement by either the adult or infant.

Figure 5:
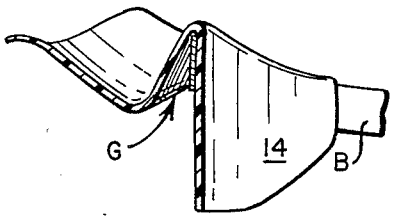
FIG. 5 is a sectional view taken along the section line 5—5 in FIG. 3.

Referring to FIG. 5, it will be seen that the seat and skirt portions define a V-shaped groove G for receiving the support belt. Preferably, the top of the groove G along which the top edge of the belt makes contact is substantially higher than the bottom 12 of the seat portion. This allows the infant to be positioned slightly below the waistline of the wearer, in a more comfortable position than higher up on the waist. Also preferred is that the length of the skirt portion approximates the length of the seat portion. This geometry, coupled with the flexibility of the skirt, serves to broadly distribute the forces exerted by the weight of the infant over the hip region of the user. Of course, belt B serves to transfer some of the infant's weight to other hip of the adult wearer and, furthermore, distributes the infant's weight about the wearer's waist.

It is important to note that, while the infant carrier of the invention may include its own support belt, the carrier may simply make use of the wearer's belt. That is, the skirt portion of the shaped member may simply be tucked inside the wearer's waistband an secured by the wearer's belt.

To reduce any tendency for the carrier to slide down the hip of the wearer while under load, a thin pad P (shown in phantom in FIG. 3) of non-slip material (e.g., rubber or felt) may be affixed to the inside of the skirt portion. Preferably, the pad thickness is between 1 and 5 mm.

In contrast with the prior art infant carriers of the backpack or shoulder sling types, it is apparent that the carrier of the invention applies the weight of the infant more directly to the legs of the wearer. By virtue of its design and being waist-mounted, the weight of the infant is primarily felt by the wearer at two locations, one being at waist level owing to the force applied by the belt at a location along the waist, especially at a location opposite the carrier, and the other being in the hip region, primarily at the lowest level of the skirt. The muscles in these two areas are relatively large and not apt to tire easily. Also, by virtue of the carrier's location at or slightly below waist level, there is no need, or for that matter any benefit, for the wearer to bend forward, backward or to one side at the waist to counter-balance the weight of the infant. Moreover, having no supporting straps whatever, it is a simple matter to place the infant on the carrier. Contrast this with the backpack carriers which usually require two people to properly position a squirming infant in the carrier.

Figure 6:
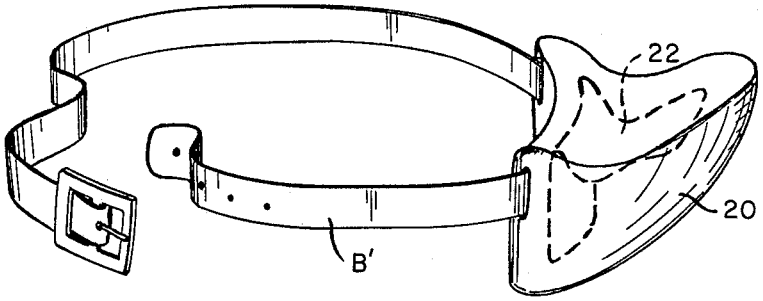
FIGS. 6–8 are perspective, side elevation and cross-sectional views, respectively, of an alternative embodiment of the invention.
Figure 8:
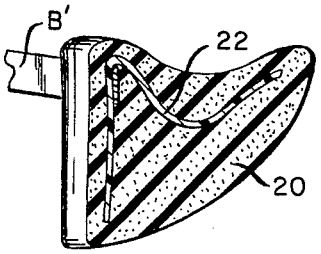
Figure 7:
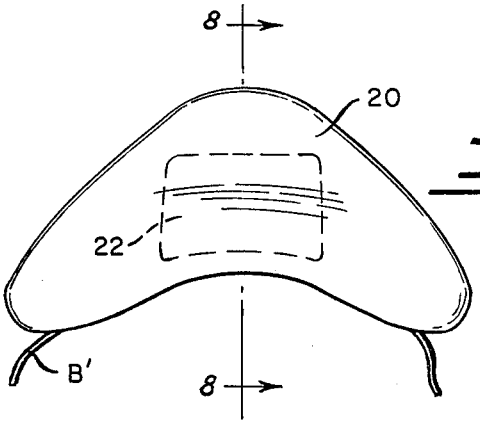

Referring now to FIGS. 6–8, an alternative design of the waist-mounted infant carrier of the invention is shown to comprise a molded member 20 of compressible material, e.g., foam rubber or polyurethane foam, of relatively high durometer, and belt means B′ for securing such member to the carrier-wearer's waist. Here, the molded member need not be as contoured as the above-described shaped member 10 since the compressibilty of the molded member allows such member to take the shape of the infant's buttocks and the wearer's hip region. As best shown in FIG. 8, a rigid reinforcing member 22 is embedded in the molded member. Member 22 causes the molded member to retain its infant-supporting shape and function when the molded member is sat upon by an infant. Preferably, the reinforcing member has a V-shaped cross-section, as shown in FIG. 8. Member 20 defines a slot for receiving a support belt (B′), such slot being located so that a received belt is located at the top of the groove or channel defined by the V-shaped reinforcing member. The reinforcing member may comprise a relatively rigid plate of plastic or metal having a width of about 8 to 12 cm. and a thickness of about 2 mm.

While the invention has been described with particular reference to preferred embodiments, obvious variations can be made without departing from the spirit of the invention. Such variations are intended to fall within the scope of the invention, as defined by the following claims.

We claim:

1. A waist-mounted infant carrier adapted to be worn about the waist of an adult for supporting and transporting an infant in a position in which the legs of the infant straddle the waist of the adult, said carrier comprising a compressible contoured member adapted to provide support for the buttocks and upper leg portions of an infant seated thereon, said member having embedded therein a reinforcing element of V-shaped cross-section defined by a pair of angularly disposed legs, one of said legs being contoured to the hip region of the adult, and the other of said legs being contoured to receive the buttocks of an infant, said compressible contoured member extending laterally outward from each side of said one leg to resiliently support and take the shape of such upper leg portions.

2. The infant carrier as defined by claim 1 wherein said compressible member comprises foam rubber or polyurethane foam.

3. The infant carrier as defined by claim 1 wherein said compressible member defines a slot for receiving a belt for securing said member to the waist of an adult user.

* * * * *